US005533574A

United States Patent [19]

Gonzalez

[11] Patent Number: 5,533,574

[45] Date of Patent: Jul. 9, 1996

[54] DUAL CONCENTRIC STRING HIGH PRESSURE RISER

[75] Inventor: Romulo Gonzalez, Slidell, La.

[73] Assignee: Shell Oil Company, Houston, Tex.

[21] Appl. No.: 498,121

[22] Filed: Jul. 3, 1995

Related U.S. Application Data

[63] Continuation of Ser. No. 167,100, Dec. 20, 1993, abandoned.

[51] Int. Cl.[6] ..... E21B 7/12

[52] U.S. Cl. ..... 166/358; 166/359; 175/7

[58] Field of Search ..... 175/7, 5; 166/358, 166/359, 345

[56] References Cited

U.S. PATENT DOCUMENTS

| | | | |
|---|---|---|---|
| 2,684,575 | 7/1954 | Pryor et al. | 166/358 |
| 3,196,958 | 7/1965 | Travers et al. | 175/7 |
| 3,481,294 | 12/1969 | Vincent | 175/7 X |
| 3,741,294 | 6/1973 | Morrill . | |
| 3,800,869 | 4/1974 | Herd et al. . | |
| 3,827,486 | 8/1974 | Hall | 166/359 |
| 3,971,576 | 7/1976 | Herd et al. . | |
| 3,974,875 | 8/1976 | Herd et al. . | |
| 4,053,023 | 10/1977 | Herd et al. | 175/7 |
| 4,059,148 | 11/1977 | Blomsma | 175/7 X |
| 4,081,039 | 3/1978 | Wardlaw | 175/7 |
| 4,216,834 | 8/1980 | Wardlaw | 175/7 |
| 4,291,772 | 9/1981 | Beynet | 175/7 X |
| 4,428,433 | 1/1984 | Watkins | 166/345 |

FOREIGN PATENT DOCUMENTS 2019471 10/1995 United Kingdom .

*Primary Examiner*—Hoang C. Dang
*Attorney, Agent, or Firm*—Mark A. Smith

[57] ABSTRACT

A dual string high pressure riser system is disclosed for use in drilling a deepwater well through a subsea wellhead. An outer riser extends from the surface and sealingly engages the wellhead and an inner riser extends from the surface downwardly, concentrically through the outer riser to communicate with the well. A surface BOP provides well control at the top of the dual high pressure riser. In another aspect of the present invention, a method is disclosed for conducting deepwater drilling operations in which a surface BOP and a lightweight outer riser are installed in communication with a subsea wellhead and a first interval is drilled through the outer riser. Casing is run through the outer riser into the first interval, cemented within the borehole and sealed at wellhead. As drilling proceeds toward subterranean intervals at which high pressure might be encountered, an inner riser is deployed concentrically within the outer riser, engaging to the wellhead at its lower end and communicating with the surface facilities through the BOP at the upper end. Subsequent intervals are drilled through the inner riser.

17 Claims, 7 Drawing Sheets

DUAL CONCENTRIC STRING HIGH PRESSURE RISER

This is a continuation of application Ser. No. 08/167,100, filed Dec. 20, 1993.

BACKGROUND OF THE INVENTION

The present invention relates to a method and system of drilling for deepwater oil and gas reserves. More particularly, the present invention relates to a riser system through which offshore drilling operations are conducted from a surface vessel or platform.

Drilling for oil and gas counterbalances normal geopressure with a hydrostatic head of weighted drilling fluid commonly referred to as "mud." However, drilling operations sometimes encounter rapid increases in pressure known as "kicks." Blowout preventers ("BOPs") are used to contain such pressure increases during drilling and other well operations and have been adapted for offshore application. Deepwater drilling has traditionally deployed such BOPs either at the wellhead far below on the ocean floor or at the surface and connected to the wellhead through a single string high pressure riser. Both of these conventional approaches have benefits. However, each approach provides its benefits only at the cost of accepting substantial detriments.

For example, a single string high pressure riser with a surface BOP facilitates simpler well operations, riser handling and BOP maintenance. However, the pressure requirements lead to a very thick wall, heavy and expensive riser system. The high weight of the riser also tends to increase the tension required to hold up the riser in deepwater and accommodating this extra tension can seriously and adversely affect platform costs. Further, such risers are adversely impacted by riser cleaning and wear problems in deepwater deployment.

Alternatively, use of subsea BOP stacks provide high pressure shut off at the mudline, decreases the tension requirements and benefits from well established procedures. However, the heavy subsea BOP stack and associated equipment are difficult to handle, maintain and store. Further, accommodating subsea BOP stacks at the wellhead requires increased well spacing at the sea floor, which, for vertical access, requires an increase in the size of the wellbay of the surface facilities. This, in turn, adversely affects overall platform costs. Further, accommodating such storage, handling and dimensional challenges can lead to a dedicated, purpose built rig for drilling and well operations for which a modular, temporarily deployed rig would otherwise prove satisfactory.

There is thus clearly a need for a riser system and drilling method for deepwater hydrocarbon developments that provides the benefits of a surface BOP without the difficulties associated with a conventional high pressure riser.

SUMMARY OF THE INVENTION

Toward the fulfillment of this need, the present invention is a dual string high pressure riser system for use in drilling a deepwater well through a subsea wellhead. An outer riser extends from the surface and sealingly engages the wellhead and an inner riser extends from the surface downwardly, concentrically through the outer riser to communicate with the well. A surface BOP provides well control at the top of the dual high pressure riser.

Another aspect of the present invention is a method for conducting deepwater drilling operations in which a surface BOP and a lightweight outer riser are installed in communication with a subsea wellhead and a first interval is drilled through the outer riser. Casing is run through the outer riser into the first interval, cemented within the borehole and sealed in the wellhead. As drilling proceeds toward subterranean intervals at which high pressure might be encountered, a high pressure inner riser is deployed concentrically within the outer riser, engaging to the wellhead at its lower end and communicating with the surface facilities through the BOP at the upper end. Subsequent intervals are drilled through the high pressure inner riser in place within the lightweight outer riser.

BRIEF DESCRIPTION OF THE DRAWINGS

The brief description above, as well as further objects and advantages of the present invention will be more fully appreciated by reference to the following detailed description of the preferred embodiments which should be read in conjunction with the accompanying drawings in which.

Detailed Description of the Preferred Embodiments

Figure 1:
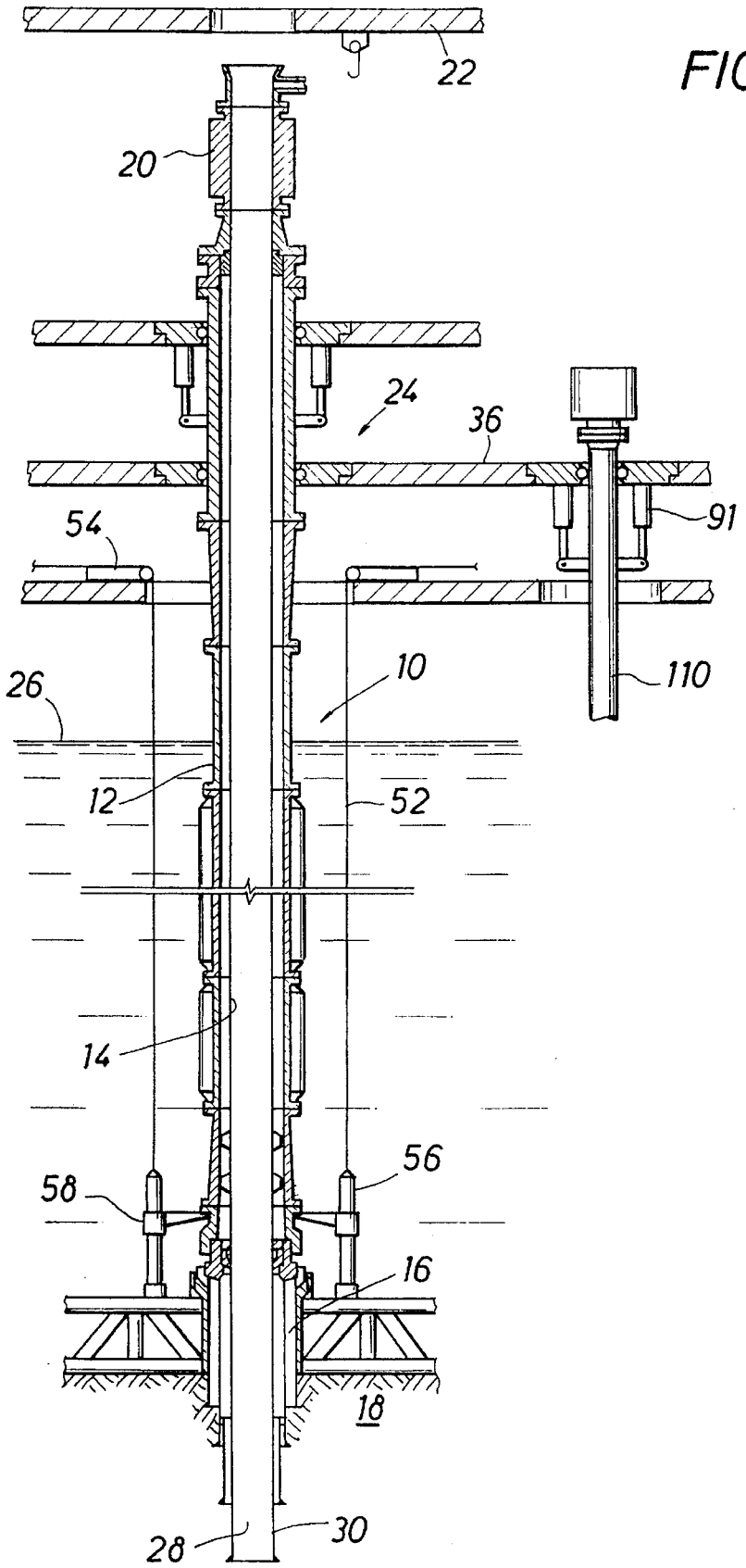
FIG. 1 is a partially cross-sectioned side elevational view of a dual string concentric high pressure riser in accordance with the present invention.

FIG. 1 illustrates a dual string concentric high pressure riser 10 in accordance with the present invention. A lightweight outer riser 12 extends from above ocean surface 26 where it is supported by offshore platform or vessel 24 to the vicinity of ocean floor 18 where it sealingly engages a subsea wellhead 16. A high pressure inner riser 14 extends downwardly, concentrically through the outer riser to communicate with well 28, preferably through a sealing engagement at wellhead 16. A surface blowout preventer 20 at drilling facilities 22 provides well control at the top of dual string high pressure riser 10.

This system permits use of lightweight outer riser 12 alone for drilling initial intervals where it is necessary to run large diameter drilling assemblies and casing and any pressure kick that could be encountered would be, at worst, moderate. Then, for subsequent intervals at which greater subterranean pressures might be encountered, high pressure inner riser 14 is installed and drilling continues therethrough. The inner riser has reduced diameter requirements since these subsequent intervals are constrained to proceed through the innermost of one or more previously set casings 30 of ever sequentially diminishing diameter. Further, outer riser 12 remains in place and is available to provide positive well control for retrieval and replacement of inner riser 14 should excessive wear occur in the inner riser.

Providing the high pressure requirements with smaller diameter tubular goods for inner riser 14 provides surface accessible, redundant well control while greatly diminishing the weight of the riser in comparison to conventional, large diameter, single high pressure risers. This net savings remains even after including the weight of lightweight outer riser 12. Further, the easy replacability of the inner riser permits reduced wear allowances and facilitates additional benefits by using tubular goods designed for casing to form high pressure inner riser 14. In addition, the use of the inner riser protects the expensive outer riser from wear. The use of the inner riser also reduces the diameter in the annulus, thereby easing hole cleaning.

The dual concentric string high pressure riser system and method of the present invention may be more fully understood by way of example, referencing a well plan design developed assuming approximately 3,000 feet of water and a total depth for the well of 18,000 feet. FIGS. 2–15 illustrate the practice of the method and the deployment of the system. This example is for drilling from a tension leg platform ("TLP") which is a leading deepwater platform concept for which the costs ordinarily rise rapidly as a function of increases in the load on the platform. However, those skilled in the art will find these teachings applicable to a wide variety of offshore platforms and vessels from which drilling operations might be conducted.

Figure 2:
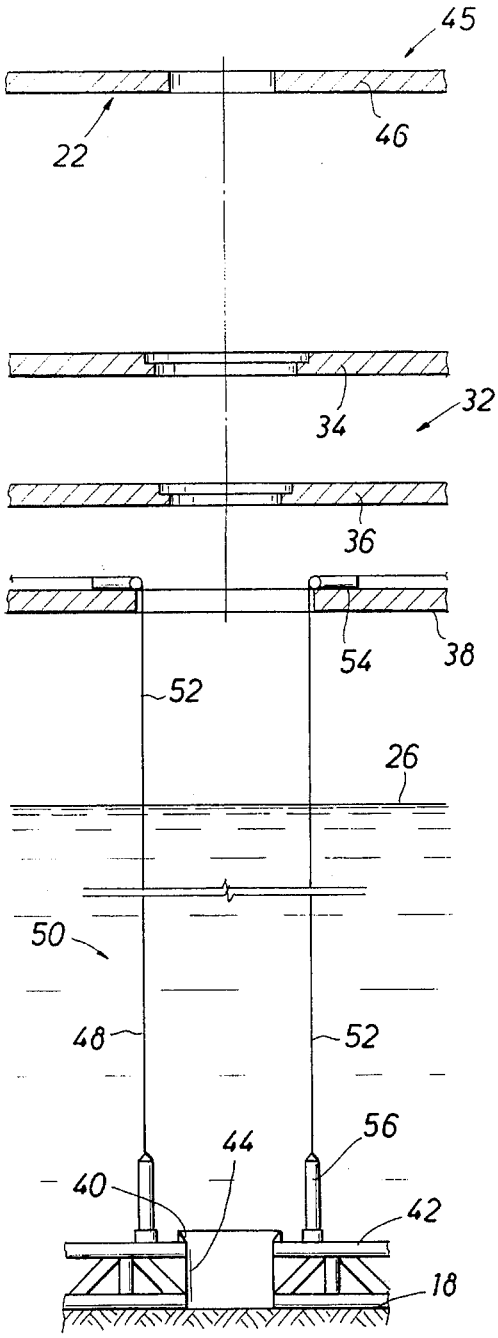
FIG. 2 is a side elevational view of a running system between an offshore platform and a subsea well guide.

FIG. 2 illustrates three decks of a TLP 32, including main deck 34, tree deck 36 and service deck 38. The TLP has been installed over a selected well site at which a plurality of well guides 40 are installed, possibly within a drilling template 42 as illustrated. In this embodiment, a contract rig 45 is loaded by barge transfer onto TLP 32 for conducting drilling operations. The drilling rig is represented in these figures by rig floor 46 and includes conventional draw works, rotary table, and other drilling facilities that have been omitted from the illustrations for the sake of simplicity. The rig is skidded into a slot vertically aligned with the well guide selected for drilling.

A running system 50, e.g., guide means 48, is established between the surface facilities and well guide 40. A remotely operated vehicle ("ROV") can conveniently assist the subsea aspects of this installation. Guide means 48 includes guidelines 52, guide tensioners 54, guide posts 56 and guide frame 58. See also FIGS. 1 and 3. Guide frame 58, installed onto guide lines 52, is thus able to guide equipment lowered by the draw works toward well guide 44 and reception of the guide frame onto guide posts 56 secures alignment in the final approach for equipment to enter the well guide.

Figure 3:
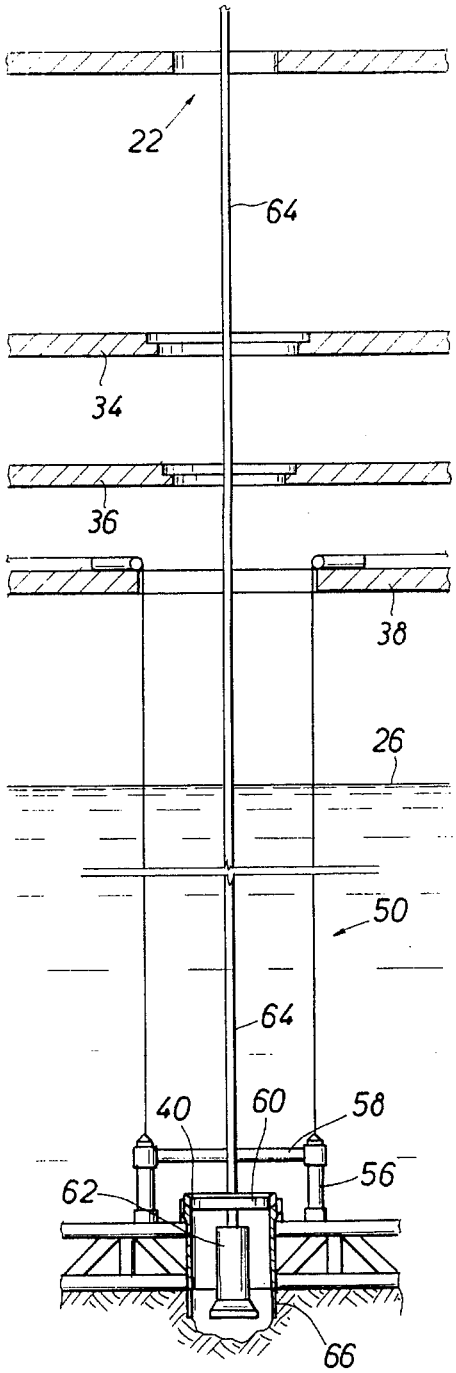
FIG. 3 is a partially cross-sectioned side elevational view of the setting of structural casing within the subsea well guide.
Figure 4A:
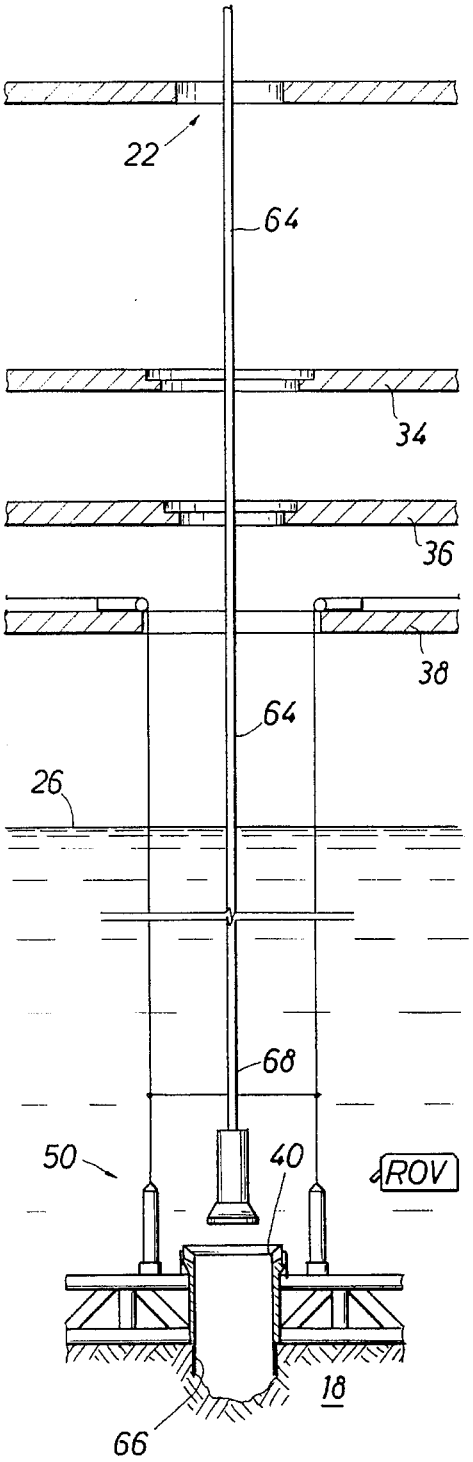
FIG. 4A is a partially cross-sectional side elevational view of drilling operations at a subsea well guide.
Figure 4B:
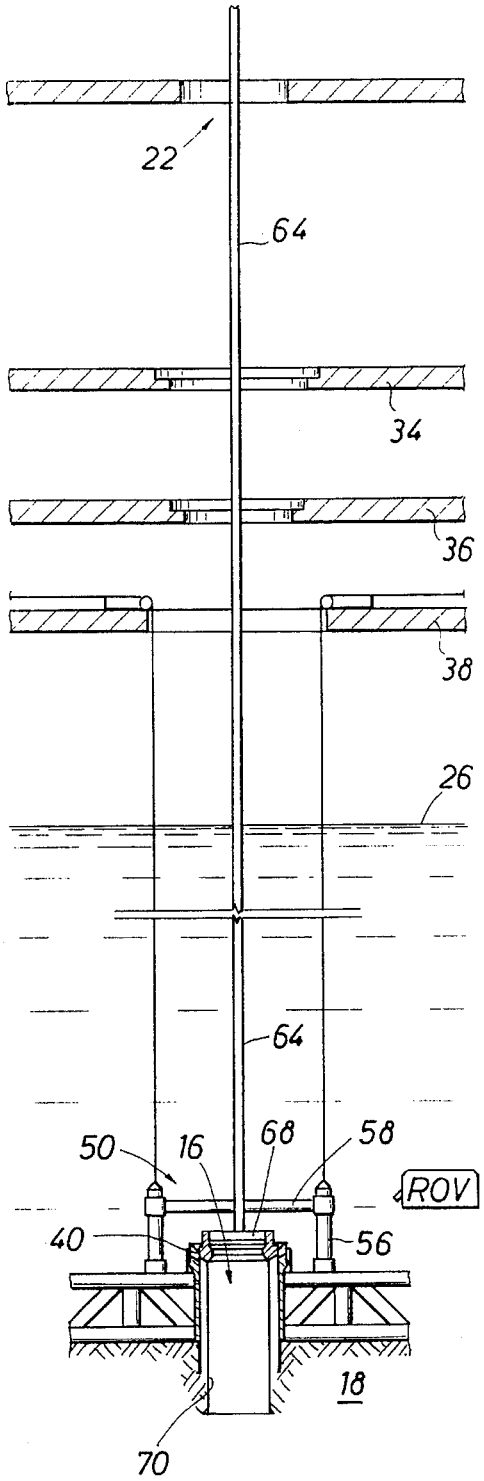
FIG. 4B is a partially cross sectioned side elevational view of operations setting a conductor casing.

In FIG. 3 a structural casing 66 is installed on a running tool 60 and lowered by the draw works on a string including a jet 62, running tool 60, and drill pipe 64 and which is guided with running system 50 through connection to guide frame 58. Jet 62 helps place structural casing 66 by washing sediment out of the way and the structural casing is set within well guide 40 toward assembly of wellhead 16. Running tool 60 releases structural casing 66 and the string is retrieved.

A drilling assembly 68 is made up, run and a large diameter borehole is established through well guide 40. See FIG. 4A. This drilling interval is through unconsolidated sediment which is incompetent to maintain pressure so that well control is not an issue and returns need only be taken to the mudline at ocean floor 18. Drilling assembly 68 is retrieved and a large diameter conductor casing 70 is placed on a running tool 60 and lowered on a string of drill pipe 64 with alignment assistance from running system 50. See FIG. 4B. The upper end of conductor casing 70 provides high pressure housing 72 and completes wellhead 16. The length of conductor casing is cemented to the borehole wall and the string is retrieved.

Figure 5:
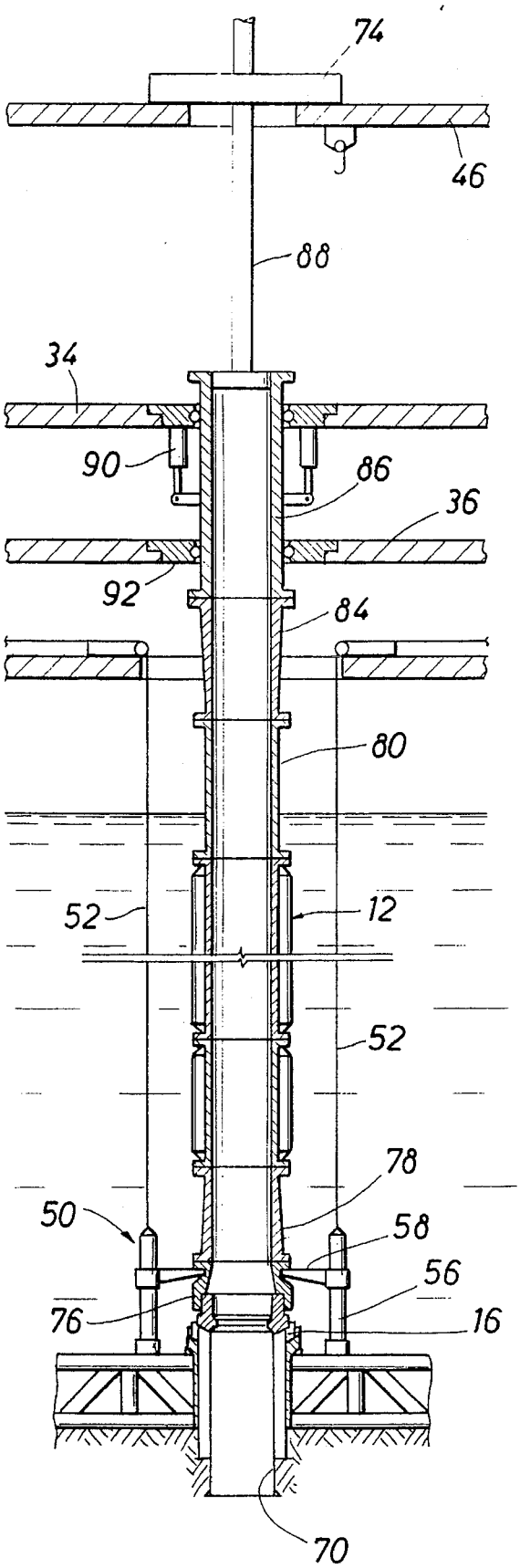
FIG. 5 is a partially cross-sectional view of a lightweight outer riser.

In this design case, the total depth of this interval may be 1500–2000 feet at this point and further drilling for this design site must anticipate a possibility of moderate kicks in the geopressure. Outer riser 12 is fully capable of containing such moderate pressure, is of sufficient diameter to permit unimpeded runs of large diameter drilling assemblies and casings appropriate at this stage of the well plan, and is nevertheless relatively lightweight. FIG. 5 illustrates installation of lightweight outer riser 12. In this design case, the outer riser is too large for the rotary drive (and slips) of the drilling rig to accommodate and these are replaced with a special purpose riser spider 74 for riser make-up. Here the riser string includes a high pressure connection 76, a lower stress joint 78, a series of running joints 80 interspersed with a series of buoyed riser joints 82, a top stress joint 84, and a tensioner joint 86. Each joint is made-up and riser section is lowered through riser spider 74. Again, lowering operations are assisted by running system 50 and once the outer riser is fully assembled, it is lowered below rig floor 46 on riser running tool 88. However, it is desired that outer riser 12 not land on wellhead 16 while suspended solely by the draw works. Rather, greater control in landing can be accomplished with tensioners 90 such as hydraulic rams which, in the preferred embodiment, are installed as a modular cassette between main deck 34 and tensioner joint 86. Further, it is desirable to control deployment of the outer riser as it passes through tree deck 36 with rollers 92 conveniently installed in a modular cassette form. Rollers and tensioners installed, outer riser 12 is landed with the aid of tensioners 90 and high pressure connection 76 sealing engages wellhead 16 with mechanical or hydraulic actuation.

Figure 6A:
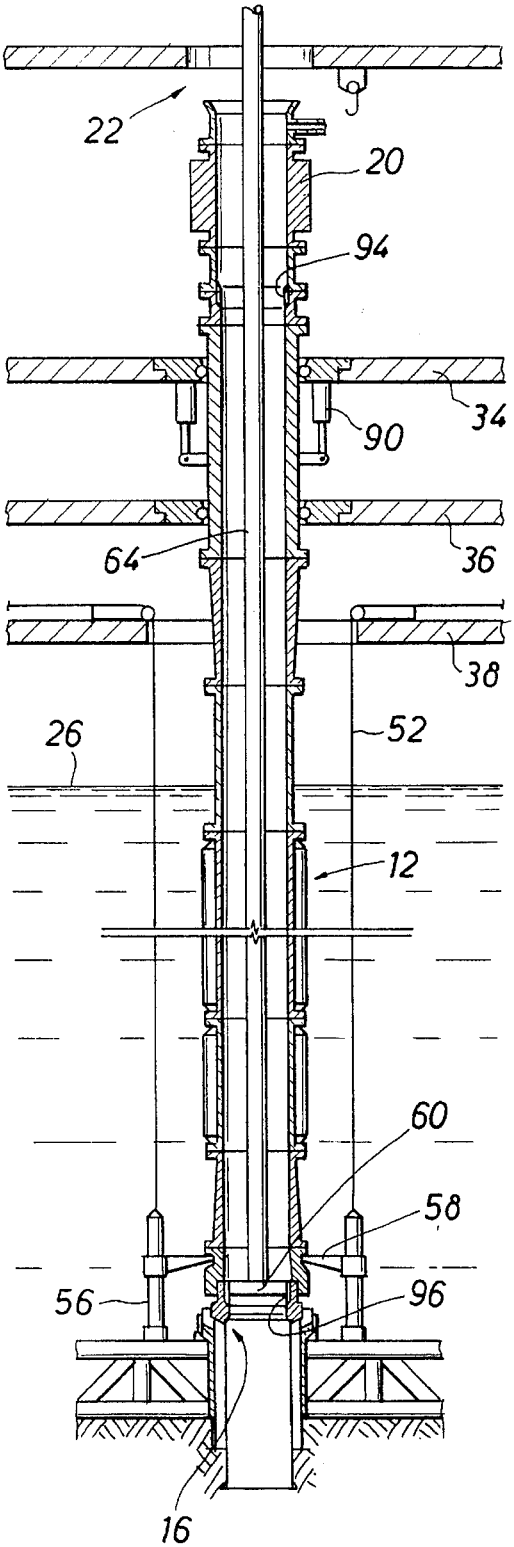
FIG. 6A is a partially cross-sectional side elevational view of preparations for drilling though the lightweight outer riser.
Figure 6B:
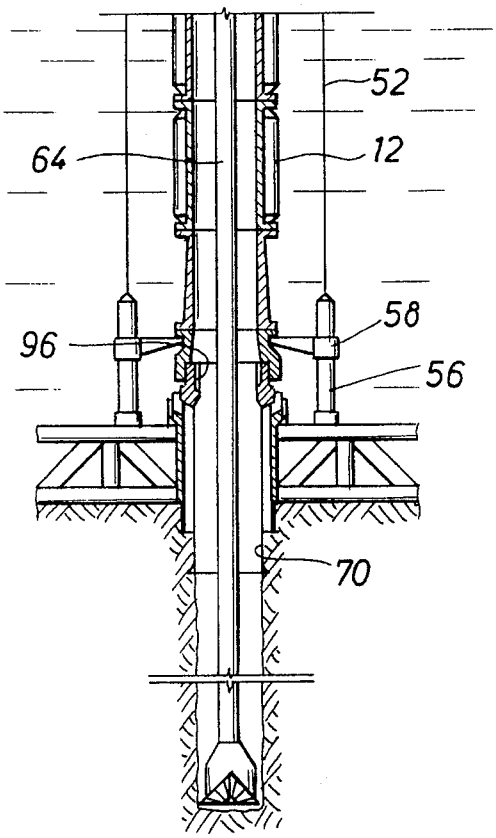
FIG. 6B is a partially cross-sectional side elevational view of drilling operations through the lightweight outer riser.
Figure 7:
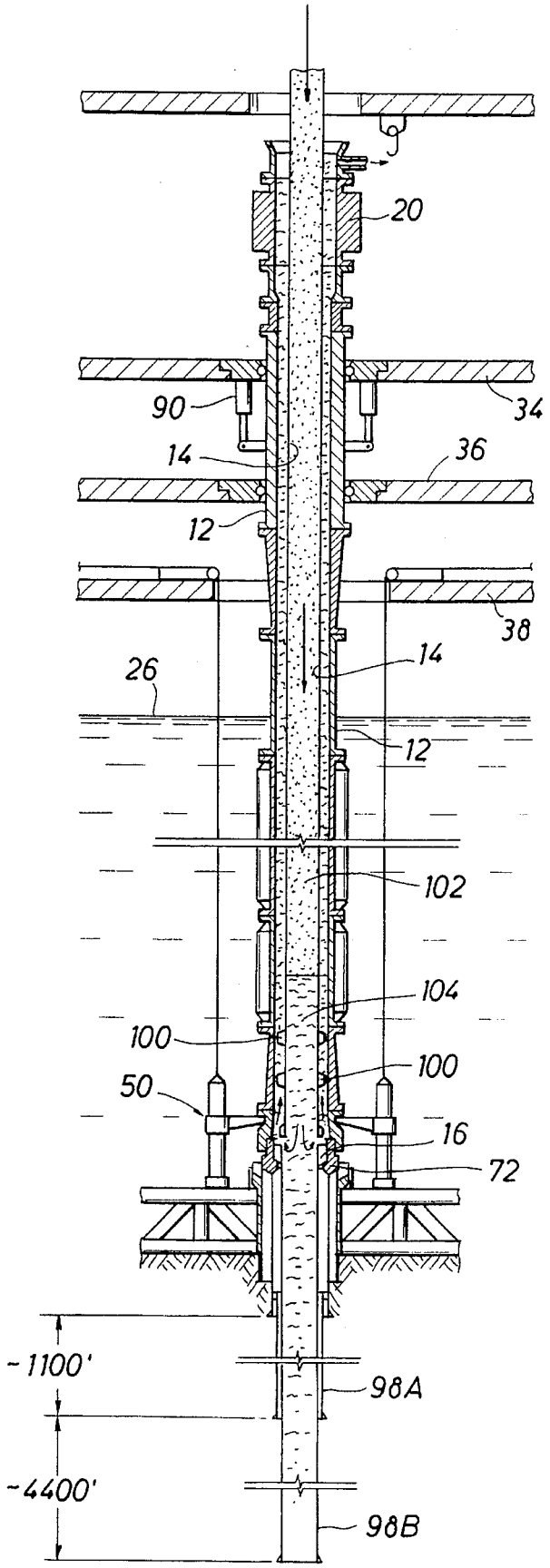
FIG. 7 is a partially cross sectional side elevational view of the installation of the high pressure inner riser.

FIG. 6A illustrates preparation of the installed lightweight outer riser for drilling operations. BOP 20 is installed at the top of outer riser 12 and a surface wellhead bushing 94 and a subsea wellhead bushing 96 are installed with running tool 60 run on drill pipe 64 through the outer riser. These bushings protect connection surfaces for later installation of sealing elements and high pressure inner risers during drilling operations. Drilling then proceeds through intervals that might be subject to moderate, but not high, geopressure kicks. See FIG. 6B. Each such interval is conventionally cased and cemented after it is drilled. See, e.g., successive casings 98A and 98B. In this design, it is convenient to hang off intermediate casing 98A subsurface. See FIG. 7. The last interval drilled before reaching regions having a potential for higher geopressure kicks is then cased with a casing 98B hung off of high pressure housing 72 at wellhead 16 after removal of subsea well head bushing 96. See FIG. 6B. The later casing is set to a depth of about 10,000 feet in the design case of this example.

Returning to FIG. 7, drilling of subsequent intervals will require a high pressure riser, supplied by the present invention with a high pressure inner riser 14 run concentrically within outer riser 12. The inner riser is assembled and lowered through BOP 20 to maintain positive control of wellbore pressures during this operation. Further, it is noted that "concentric" as used herein to define the relation of the inner and outer risers means the inner riser extends longitudinally within the outer riser, but is not necessarily constrained to having literally coaxial centers. However, tighter constraints apply where inner riser 14 connects to high pressure housing 72 of subsea wellhead 16 and a plurality of centralizing stabilizers 100 can be conveniently provided at the base of the inner riser to assist this alignment for a sealing connection.

After proper fit and alignment for mating inner riser 14 in communication with the well, preferably by a connection within high pressure housing 72 of subsea wellhead 16, the inner riser is lifted slightly from its landing position and gelled sea water 102 is pumped down the inner riser to displace mud 104 from both the inner riser and the annular space between the inner and outer risers i.e., shut down the well.

Figure 8:
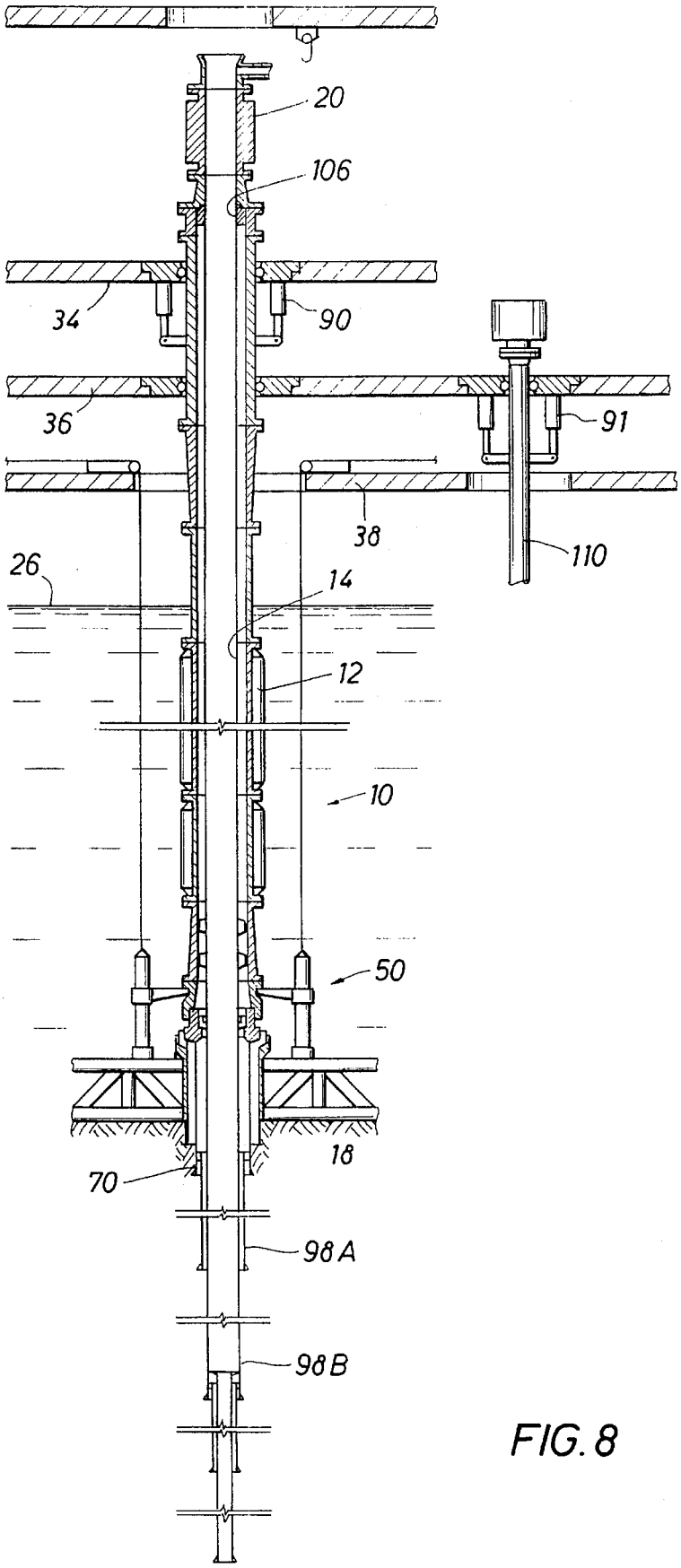
FIG. 8 is a partially cross sectional view of a dual string concentric high pressure riser during well operations.

Referencing FIG. 8, inner riser 14 is landed into sealing engagement with subsea wellhead 16 after the mud has been displaced. Gelled seawater 102 has been omitted from the figure for the sake of simplicity much as mud has been omitted from many of the preceding figures where those having ordinary skill in the art will appreciate mud would be present. BOP 20 is then removed, the top of the annulus is closed at seal 106, and a higher pressure BOP 20 is installed to contain and divert any high pressure kicks through the inner riser. The inner riser and BOP stack can be pressure tested, then engaged in active service.

Drilling then advances through intervals of potential high pressure kicks, with each interval being conventionally cased until the desired total vertical depth is achieved. Pressures in the riser annulus may be monitored for leaks in the inner riser and the outer riser may be inspected by ROV.

At total depth, the well is secured, BOP stack 20 is pulled, inner riser 14 is pulled and outer riser 12 is retrieved, substantially reversing the installation process illustrated in the proceeding figures. A production riser 110 is then run, connected to the subsea wellhead and hung off in tensioners 91 from tree deck 36. See FIG. 1. The rig is then moved to the next slot and the process is repeated. When all the wells have been completed, the drilling rig may be removed from the platform.

In the preferred practice of drilling several wells in series, it is convenient for the casing that served as an inner riser for one well to be set and cemented downhole in the next. Thus, riser wear is controlled in a manner requiring less wear allowance and without waste.

The example of this well plan design demonstrates the ability of the present invention to bring deepwater drilling the benefits of a surface completion without the tradeoffs required by prior practices. Further, these weight reductions can substantially improve the economics of weight sensitive design approaches such as TLPs and can provide new opportunities for relatively weight insensitive designs such as deepwater fixed and compliant towers for which integral riser conductors have been assumed justified, in part, as reasonably required for well operations through a surface accessible BOP.

Other modifications, changes and substitutions are intended in the forgoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A riser system for use in drilling and producing a deepwater well through a subsea wellhead, comprising:

A) a dual string concentric high pressure riser system for drilling operations, comprising:

1) a retrievable outer riser extending from the surface and sealingly connected to the subsea wellhead for use alone in drilling an initial, low pressure interval;

2) a retrievable inner riser in communication with the well and extending from the surface downwardly to the subsea wellhead inside the outer riser for use in drilling intervals of potentially high pressure; and 3) a surface BOP providing well control at the top of the inner riser; and B) a production riser system comprising:

1) an independent production riser;

2) a connection for accepting the independent production riser at the subsea wellhead after retrieving the inner and outer risers; and 3) Christmas-tree at the top of the independent production riser providing a surface completion for the well.

2. A riser system in accordance with claim 1 wherein the inner riser is a casing string.

3. A riser system in accordance with claim 2, wherein the lower end of the casing string sealingly engages the wellhead, further comprising an annular region of secondary, low pressure containment between the inner and outer risers extending from the wellhead to the BOP.

4. A riser system in accordance with claim 3 wherein the inner riser further comprises a release at wellhead whereby the inner riser above the wellhead can be retrieved to the surface.

5. A riser system for use in drilling and producing a deepwater well through a subsea wellhead, comprising:

A) a dual string concentric high pressure riser system for drilling operations, comprising:

1) a retrievable low pressure outer riser extending from the surface and sealingly connected to the subsea wellhead for use alone in drilling initial low pressure intervals;

2) a retrievable high pressure inner riser in communication with the well and extending from the surface downwardly to the subsea wellhead inside the outer riser to separate the well from the low pressure outer riser for drilling high pressure intervals;

3) a seal closing the annulus between the inner and outer risers; and 4) a surface BOP providing well control at the top of the inner riser; and B) a production riser system comprising:

1) a lightweight production riser;

2) a connection for accepting the lightweight production riser at the subsea wellhead after retrieving the inner and outer risers; and 3) a Christmas-tree at the top of the production riser providing a surface completion.

6. A riser system in accordance with claim 5, wherein the inner riser is a casing string which sealingly engages the wellhead at its lower end, further comprising an annular region of secondary, low pressure containment between the inner and outer risers extending from the wellhead to the BOP.

7. A riser system in accordance with claim 6 wherein the high pressure inner riser further comprises a release at wellhead whereby the high pressure inner riser above the wellhead can be retrieved to the surface.

8. A riser system in accordance with claim 7 wherein the high pressure inner riser is a casing string.

9. A riser system in accordance with claim 8 wherein the well further comprises a plurality of conventional casing strings hung-off and cemented in place at or below the wellhead.

10. A method for conducting deepwater drilling and production operations comprising:

A) installing a subsea wellhead;

B) establishing lightweight outer riser with a surface BOP between an offshore platform and the subsea wellhead;

C) drilling and casing at least an early interval through the lightweight outer riser;

D) establishing a high pressure inner riser between the platform and the subsea wellhead, comprising:

1) running the high pressure inner riser through the BOP and longitudinally down the inside of the lightweight outer riser;

2) temporally shutting down the well, removing the BOP and connecting the high pressure inner riser to the subsea wellhead in communication with the well;

3) sealing the top of the annulus established between the lightweight outer riser and the high pressure inner riser; and 4) connecting a high pressure BOP to the top of the high pressure inner riser; drilling and casing additional intervals through the high pressure inner riser;

E) temporarily shutting down the well and pulling the BOP and inner riser and retrieving the outer riser;

F) running and connecting a lightweight production riser to the subsea wellhead with the inner and outer riser removed; and G) producing the well through a surface completion.

11. A method of conducting deepwater drilling and production operations in accordance with claim 10 wherein running the high pressure inner riser comprises running a casing string.

12. A method of conducting deepwater drilling and production operations in accordance with claim 11 further comprising using the casing string deployed for establishing a high pressure inner riser while drilling one well for casing early intervals through the lightweight outer riser in a subsequent well.

13. A method of conducting deepwater drilling and production operations in accordance with claim 12 wherein the step of temporarily shutting down the well, removing the BOP and connecting the high pressure inner riser to the subsea wellhead in communication with the well further comprises:

positioning the lower end of the high pressure inner riser for connection with the subsea wellhead;

slightly lifting the aligned high pressure inner riser;

displacing mud within the high pressure inner and lightweight outer risers by pumping gelled seawater through the high pressure inner riser; and landing the high pressure inner riser into sealing engagement with a high pressure housing of the subsea wellhead.

14. A method for conducting deepwater drilling operations, comprising:

installing a subsea wellhead;

establishing lightweight outer riser with a surface BOP between an offshore platform and the subsea wellhead;

drilling and casing at least an early interval through the lightweight outer riser; establishing a high pressure inner riser between the platform and the subsea wellhead, comprising:

running a casing string to form the high pressure inner riser through the BOP and longitudinally down the inside of the lightweight outer riser; temporally shutting down the well, removing the BOP and connecting the high pressure inner riser to the subsea wellhead in communication with the well, comprising:

positioning the lower end of the high pressure inner riser for connection with the subsea wellhead;

slightly lifting the aligned high pressure inner riser; displacing mud within the high pressure inner and lightweight outer risers by pumping gelled seawater through the high pressure inner riser; and landing the high pressure inner riser into sealing engagement with a high pressure housing of the subsea wellhead;

sealing the top of the annulus established between the lightweight outer riser and the high pressure inner riser; and connecting a high pressure BOP to the top of the high pressure inner riser;

drilling and casing additional intervals through the high pressure inner riser; and using the casing string deployed for establishing a high pressure inner riser while drilling one well for casing early intervals through the lightweight outer riser in a subsequent well.

15. A method for conducting deepwater drilling operations, comprising:

installing a subsea wellhead;

establishing lightweight outer riser with a surface BOP between an offshore platform and the subsea wellhead;

drilling and casing at least an early interval through the lightweight outer riser; establishing a high pressure inner riser between the platform and the subsea wellhead, comprising:

running the high pressure inner riser through the BOP and longitudinally down the inside of the lightweight outer riser;

temporally shutting down the well, removing the BOP and connecting the high pressure inner riser to the subsea wellhead in communication with the well, comprising:

positioning the lower end of the high pressure inner riser for connection with the subsea wellhead;

slightly lifting the aligned high pressure inner riser;

displacing mud within the high pressure inner and lightweight outer risers by pumping gelled seawater through the high pressure inner riser;

landing the high pressure inner riser into sealing engagement with a high pressure housing of the subsea wellhead; and sealing the top of the annulus established between the lightweight outer riser and the high pressure inner riser;

connecting a high pressure BOP to the top of the high pressure inner riser; and drilling and casing additional intervals through the high pressure inner riser.

16. A method of conducting deepwater drilling operations in accordance with claim 15 wherein running the high pressure inner riser comprises running a casing string.

17. A method of conducting deepwater drilling operations in accordance with claim 16 further comprising using the casing string deployed for establishing a high pressure inner riser while drilling one well for casing early intervals through the lightweight outer riser in a subsequent well.

* * * * *